United States Patent [19]

Moreno

[11] 4,300,692

[45] Nov. 17, 1981

[54] LATCHING HOOK STRUCTURE FOR SUPPORTING VENDIBLE ARTICLES, PARTICULARLY TRINKETS AND THE LIKE

[75] Inventor: Vitalis Moreno, Milan, Italy

[73] Assignee: Modiani & Associati, Milan, Italy

[21] Appl. No.: 12,201

[22] Filed: Feb. 14, 1979

[30] Foreign Application Priority Data

Jul. 14, 1978 [IT] Italy ..... 25680 A/78

[51] Int. Cl.[3] ..... A47F 7/02

[52] U.S. Cl. ..... 211/87; 211/94; 248/221.3; 248/221.4; 248/467

[58] Field of Search ..... 211/87, 94, 162; 312/245, 246; 248/205 A, 467, 489, 214, 215, 221.3, 221.4; 403/331

[56] References Cited

U.S. PATENT DOCUMENTS 1,930,965 10/1933 Christy ..... 211/94 X
2,715,966 8/1955 Tieck ..... 211/94
3,279,620 10/1966 Nesbitt ..... 211/87
3,409,257 11/1968 Elm ..... 248/205 A X
3,599,918 8/1971 Patchett ..... 248/205 A X

*Primary Examiner*—Ramon S. Britts
*Assistant Examiner*—Robert W. Gibson, Jr.
*Attorney, Agent, or Firm*—Lewis H. Eslinger

[57] ABSTRACT

A latching hook structure for supporting vendible articles, particularly trinkets and the like, comprises at least one hook-like member having in cross-sectional view a p-like configuration. The smaller leg of the p-like configuration having a latching hook formation facing inwardly the greater leg of the p-like configuration and defining therewith a lead-in snap engagement passage, a hanger rod member for said hook-like member having a cross-sectional configuration similar to that of said hook-like member but arranged, in assembled condition, upside down with respect thereto and selectively in slidable snap engaging relationship therewith.

10 Claims, 8 Drawing Figures

LATCHING HOOK STRUCTURE FOR SUPPORTING VENDIBLE ARTICLES, PARTICULARLY TRINKETS AND THE LIKE

BACKGROUND OF THE INVENTION

This invention relates to a latching hook structure for supporting vendible articles, particularly trinkets and the like.

As is known, trinket articles, such as earrings, pins, and the like, are generally anchored to a small stiff card or plate formed, for connection to a display stand, with a hole or slot wherethrough one arm of the display stand is passed. This solution has, first of all, the disadvantage of preventing a good exhibition of the various articles to the potential buyer, because the cards or plates virtually overlap one another, thereby the potential buyer cannot have the exhibited articles in full view at once.

Another drawback is that it is exceedingly easy to withdraw such cards or plates from the arms or supports of the display stand, thereby any ill-intending person is given a chance to pick up articles unobserved.

A further disadvantage encountered with the cards or plates whereto trinket articles are attached is that they must be pre-arranged such as to permit their application to the various available display stand means.

SUMMARY OF THE INVENTION

Thus, this invention sets out to provide a latching hook structure which is particularly useful in supporting trinket and the like articles, although it can find application to any other fields where small weight vendible articles or objects are to be suspended, exhibited, or in any way supported.

In accordance with the above general object, it is a particular object of this invention to provide a latching hook structure which can be easily and quickly applied to any holder card or plate for trinket articles as well as any other articles of small weight, and which is extremely practical and versatile, such as to fill the individual requirements of its user.

A further object of the invention is to provide a latching hook structure so constructed as to perform in practice anti-theft functions, i.e., such as to allow the article to be removed from its stand, but only by application of a skilled effort by the operator, thereby release of the article cannot pass unnoticed to the counter personnel, thus discouraging any pilfering.

Another object of this invention is to provide a latching hook structure which, while exhibiting high reliability and safety features, is extremely simple and suitable for mass production techniques.

A not unimportant object of the invention is to provide a latching hook structure which can be easily constructed from readily available materials, requires no complex or costly equipment for its manufacture, and is of very low cost, whereby it can gain widespread acceptance by the public.

These and other objects of the invention, such as will become apparent hereinafter, are achieved by a latching hook structure for supporting vendible articles, particularly trinkets and the like, comprising at least one hook-like member having a height extension and a transverse extension and formed from a resilient material, said hook-like member having in cross-sectional view a back portion extending in the direction of said height extension, a front portion extending in the direction of said height extension, said front portion facing said back portion at an overall transverse distance therefrom, a web portion extending in the direction of said transverse extension and connecting said back portion with said front portion, a latching hook formation on said front portion and extending towards said back portion and having a preestablished transverse extension and a preestablished height extension, said latching hook formation having a tip at a preestablished transverse distance from said back portion and at a selected height distance from said web portion, said latching hook formation defining a lead-in surface facing in a direction opposite to said web portion, a hanger rod member for said hook-like member having a cross-sectional configuration similar to that of said hook-like member but arranged, in assembled condition, upside down with respect thereto and selectively in snap engaging relationship therewith, said hanger rod member having thus a corresponding front portion, a corresponding back portion at a corresponding overall transverse distance from said front portion, a corresponding web portion, a corresponding latching hook formation having a corresponding transverse extension and a corresponding height extension and a corresponding tip at a corresponding transverse distance from said corresponding back portion and at a corresponding height distance from said corresponding web portion.

It should be noted that throughout the specification the term height extension means the length of such extension when orthogonally projected on a line which in the drawing is vertical and the term transverse extension means the length of such extension when orthogonally projected on a line which in the drawing is horizontal, the terms vertical and horizontal being used only for references purposes and not in a limiting sense. The same considerations apply for the terms height distance and transverse distance.

BRIEF DESCRIPTION OF THE DRAWING

Further features and advantages will be more clearly understood by making reference to the following detailed description of a preferred, though not restrictive, embodiment of a latching hook structure for holders, particularly of trinket and the like articles, illustrated by way of example only in the accompanying drawing, where.

DESCRIPTION OF THE PREFERRED EMBODIMENTS

Figure 3:
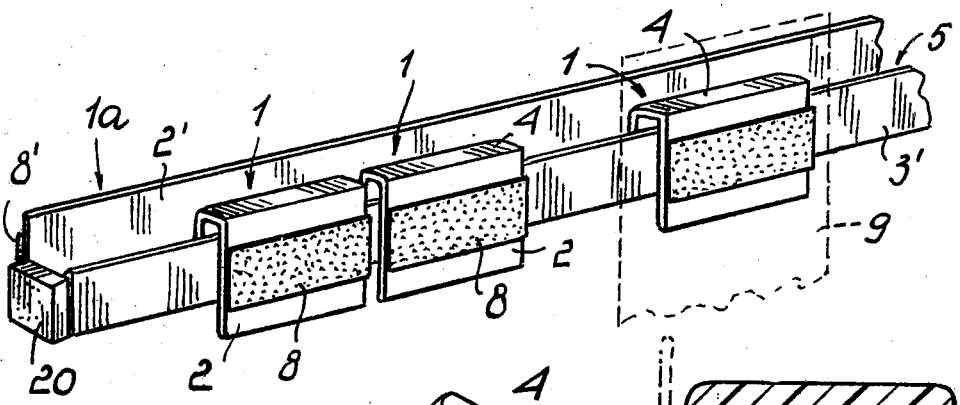
FIG. 3 shows schematically the latching hook device, wherein a plurality of hook-like members are associated with a supporting hanger rod member.
Figure 1:
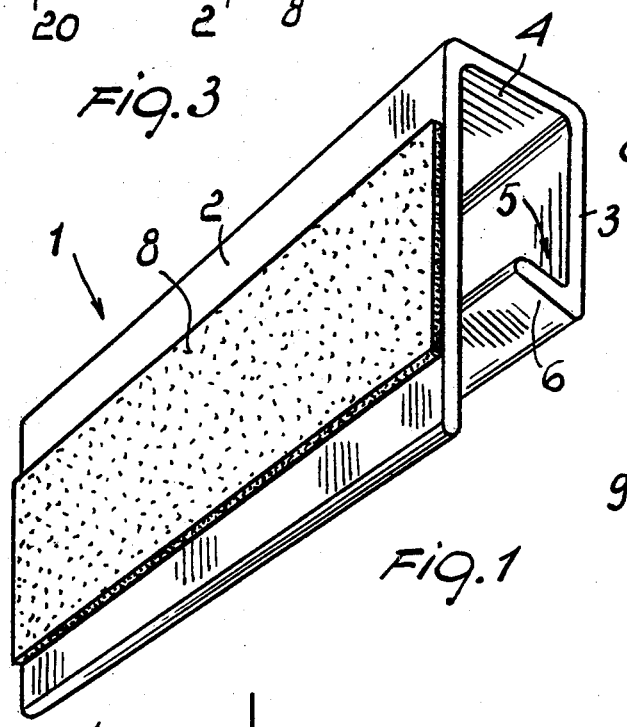
FIG. 1 shows schematically the hook-like member in perspective.
Figure 2:
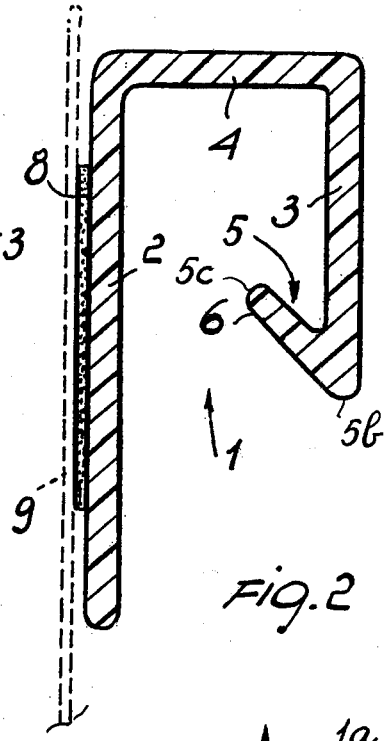
FIG. 2 is a cross-sectional view of the hook-like member.

With reference to the cited drawing figures, the latching hook structure for supporting, particularly trinket and the like articles, or objects of limited weights, comprises a hook-like member, indicated generally at 1.

Said hook-like member 1 includes a section of a resiliently deformable material, such as a plastics material.

When viewed in cross-section, the member 1 has a "p"-like configuration with a back portion 2, having of preference at least one substantially rectilinear part, which is faced by a front portion 3 at a distance therefrom, which is united or joined to the back portion 2 by a joining web portion 4.

At the free end of the front portion 3, there is provided a latching hook formation 5 which extends towards the back portion 2 and has a lead-in surface 6 intended for facilitating the application of the hook-like member 1 to the hanger or supporting member, as will be explained hereinafter.

In the drawing figures, the member 1 is shown as composed of portions with a rectilinear shape, with the portion 3 parallel to the portion 2, but it will be appreciated that nothing will change in principle if the outer configuration is changed, since the essential factor resides in the shape and arrangement of the portion 5.

It should be further noted that according to one embodiment the length of the portion 5 is such that its vertical projection is equal to, or only marginally greater than, the distance between the tip of the portion 5 and joining web portion 4, for reasons that will be explained hereinafter.

On the outer side of the back portion 2, an adhesive element is provided which comprises preferably a section of a double-adhesive tape 8, the latter being associated with the outer side of the back portion 2 and attachable to a small plate or any other element, as indicated schematically at 9.

It can be also glued to any support (without adhesive tape).

The back portion 2 may constitute by itself an element or support on which the trinkets are directly secured. For the purpose the height or length of the back portion 2 may be extended and provided with notches, slots or other means for securing thereto the trinkets, thereby eliminating the supporting cards or plates thereof.

The hook-like member 1 can be snap applied to a supporting or hanger rod member 1*a* which according to one embodiment has a cross-sectional configuration substantially equal to that of the hook-like member 1. The only difference, if any, would be the length of the member 1*a*, inasmuch as it may be advantageous, but not strictly necessary, to arrange a supporting member 1*a* having such a length as to accomodate several hook-like members 1; obviously, it will be possible to utilize a supporting hanger member having the same length as, or a slightly shorter length than, the hook-like member 1.

With reference to FIGS. 4 to 8, there is shown the latching step sequence. Note should be taken that for the purpose of clarity, these Figures show the component parts slightly out of proportion as far as the mutual distances are concerned. To accomplish said latch engagement, it will be sufficient that the hook-like member 1 be placed over the supporting member 1*a*, which in the considered embodiment has the same configuration as the hook-like member 1 and is upside down with respect to the hook-like member 1. In this position (FIG. 4) the inclined portions 6, 6' are in alignment and act in practice as lead-in elements.

By applying a certain pressure (FIG. 5), owing to the flexibility of the material used in the construction of both the hook-like member 1 and supporting member 1*a*, the latch portions 5, 5' tend to be deflected towards the inner part of the respective members 1, 1*a* with attendant sliding movement of the inclined portions 6, 6'. By maintaining the pressure (FIG. 6), the portions 5, 5' increase their deflection, while the sliding movement of the inclined surfaces 6, 6' continues, until (FIG. 7) the end of the portion 5 of the hook-like member 1 overtakes the end of the portion 5' of the supporting member 1*a*, and the related portions 5, 5' are returned to the initial position by virtue of the elastic flexibility of the material making up both the hook-like member 1 and supporting member 1*a*.

It should be pointed out here that in one of the shown embodiments the length of the portions 5 is such that its vertical projection is less than, or equal to, the distance separating the tip 5*c* of the portion 5 from portion 4, in order to facilitate release after the portions 5 of the hook-like member 1 and supporting member 1*a* have been latched together.

The same proportions apply for the member 1*a* when the latter is equal in cross-section to the member 1. Otherwise it is preferred that the vertical projection of the sum of the lengths of portions 5 and 5' is less than the vertical distance between the elbow peak 5*b* and the web 4, the same applying to the member 1*a* too.

Figures 4, 5, 6, 7, 8:
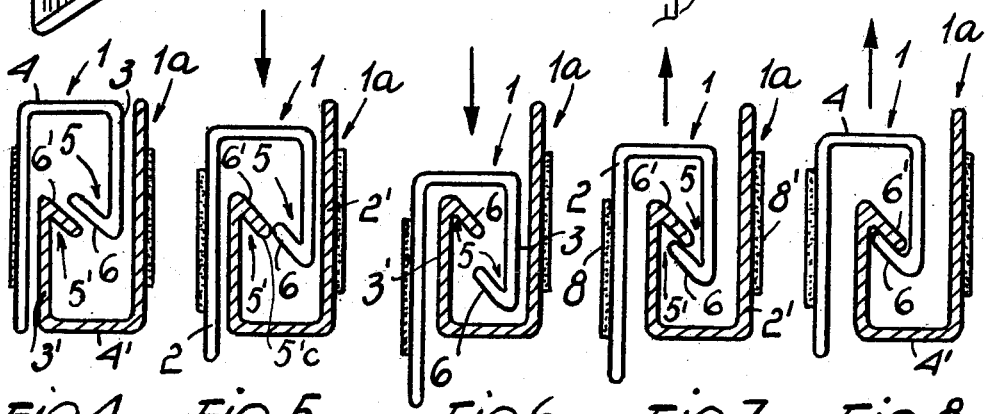
FIGS. 4, 5, 6, 7 and 8 illustrate schematically the sequential steps of snap engaging the hook-like member with the supporting member.

As shown in FIG. 8, the latch structure according to this invention also exhibits theft-preventing capabilities. In fact, if an attempt is made at removing the hook-like member 1 from the supporting hanger rod member 1*a*, the ends or tips 5*c* and 5'*c* of the portions 5 of the hook-like member 1 and supporting member 1*a* interface with each other, because, as already mentioned above, according to one embodiment the length of the latch portion 5 is such that its horizontal projection is greater or equal to one half the distance between the portion 2 and portion 3 when 1 and 1*a* are equal in cross-section, thereby they are brought to interfere with each other and prevent a quick release. Obviously, by applying a greater force, one causes, during the release step, divarication by bending of the respective portions 5,5' to achieve disengagement; however, this cannot be done as a matter of course, and requires a skilled movement and a certain effort, thus preventing any ill-intending persons from easily picking up unnoticed objects put on display by means of the latch device according to this invention.

If the dimensions of the members 1 and 1*a* are different, in order to obtain the desired marginal interference between the tips 5*c* and 5'*c* during an assembly stage the horizontal projection of the sum of the lengths of the portions 5 and 5' should be marginally greater than the distance between the portions 2 and 3 or 2' and 3'.

It should be further added that, of preference, side plugs 20 may be applied to the ends of the supporting member 1*a* which are adapted for force fit insertion into the sectional member to prevent any accidental lateral sliding off of the hook-like members 1 from the supporting member 1*a*. The plug members 20 have a stem or core configurated to mate the inside of the sectional members 1 or 1*a* and a head with a configuration mating the outside of the sectional members 1 and 1*a*. Understandably, upon removal of the plugs 20, the hook-like members 1 can be withdrawn sideways. It is natural that this function of preventing the lateral withdrawal can be also provided by other mechanical or conventional closing systems. The hanger rod member can be supported on any suitable support, stand or frame.

From the foregoing description, it will be apparent that the invention achieves its objects, and in particular its extremely simple construction is pointed out, since it is possible to form from a single element made of a sectional material easily obtained by extrusion, both the hook-like part and supporting part, and moreover, owing to the provision of double-adhesive tape on the back portion 2, or glueing it at any support, it becomes extremely quick and easy to apply the hook-like member 1 to any type of card holder for trinket articles, or even according to another modification any object or element which it is desired to suspend or display in a manner whatever, may be directly secured to the back portion 2 of the hook-like member 1, which in such case is provided with adequate securing means.

Furthermore, by forming the hook-like member 1 and supporting member 1*a* from sectional material, the length of such members may be varied at will and very easily, since it will be sufficient to cut off the extruded sectional bar the desired length.

When this latching hook structure is used for trinkets, it has been found suitable to select a size according to which the web portion 4 and the front portion 3 have both a cross-sectional dimension of 5 mm and a thickness of from 0.5 to 0.8 mm. The distance between the back portion 2 and the front portion 3 will thus be of about 4 mm.

The invention as described is susceptible to many modifications and variations, all of which fall within the scope of the instant inventive concept.

Moreover, all of the details may be replaced by other technically equivalent elements.

In practicing the invention, the materials employed, although the best results are to be obtained through the utilization of plastics materials, as well as the dimensions and particular configurations may be any ones to suit individual applicational requirements.

I claim:

1. An interlocking hook structure for supporting vendible articles comprising at least one hook-like member formed from a resilient material including, in cross-section, a vertical back portion, a vertical front portion extending parallel to said back portion, a joining web portion uniting said front and back portions, and a hook portion extending at a slant from a point on said front portion remote from said web portion toward said back portion and said web portion to a point intermediate between said back and front portions; and interlocking hanger means associated with said at least one hook-like member in snap engagement therewith for supporting said hook-like member and cooperating with the hook portion thereof to prevent undesired disengagement of said hook-like member therefrom.

2. An interlocking hook structure according to claim 1, wherein said interlocking hanger means includes a hanger rod formed of a resilient material and having a cross-sectional configuration that is substantially the inverse of that of said hook-like member, said hanger rod including, in cross section, a vertical back portion adapted to be supported vertically;

a vertical front portion extending parallel to the back portion of the hanger rod;

a web portion uniting the front and back portions of the hanger rod; and a hook portion extending toward the back portion and toward the web portion of the hanger rod, at a slant corresponding to the slant of the hook portion of the hook-like member, to a point intermediate the front and back portions of the hanger rod.

3. An interlocking hook structure according to claim 2, wherein the vertical projection of the hook portion of the hook-like member onto the front portion thereof is substantially equal to the distance from said intermediate point to said joining web portion.

4. An interlocking hook structure according to claim 2, wherein the projection of the hook portion of hook-like member onto the front portion thereof is slightly less than the distance between said intermediate point and said joining web portion.

5. An interlocking hook structure according to claim 2, wherein the sum of the slant lengths of the hook portions of said hook-like member and said hanger rod is less than the distance from said point on said front portion to said web portion of said hook-like member.

6. An interlocking hook structure according to claim 2, wherein the sum of the horizontal distance from the intermediate point to the front portion of the hook-like member and the horizontal distance from the intermediate point to the front portion of the hanger rod is marginally greater than the distance between the back and front portions of said hook-like member.

7. An interlocking hook structure according to claim 2, further comprising at least one plug member fixed on one end of said hanger rod to prevent lateral withdrawal therefrom of said hook-like member.

8. An interlocking hook structure according to claim 1, wherein said back portion extends vertically from said web portion farther than does said front portion.

9. An interlocking hook structure according to claim 8, wherein said back portion includes means for attaching vendible articles thereon.

10. An interlocking hook structure according to claim 9, wherein said means for attaching includes double-sided adhesive tape arranged on a surface of said back portion remote from said front portion.

* * * * *